United States Patent [19]

Eveloff

[11] 4,194,208

[45] Mar. 18, 1980

[54] SWINGABLE SUPPORT FOR CONCEALABLY MOUNTING ANTENNAS ON VEHICLES

[75] Inventor: Steven Eveloff, Springfield, Ill.

[73] Assignee: Shur-Lok Manufacturing Co., Inc., Hutchins, Tex.

[21] Appl. No.: 674,957

[22] Filed: Apr. 8, 1976

[51] Int. Cl.[2] ..... H01Q 1/32

[52] U.S. Cl. ..... 343/715

[58] Field of Search ..... 248/514, 515, 516, 517, 248/528, 529, 538, 539, 218, 308; 343/713, 714, 715, 716, 718

[56] References Cited

U.S. PATENT DOCUMENTS

| | | | |
|---|---|---|---|
| 1,329,394 | 2/1920 | Fry et al. | 248/539 |
| 2,295,370 | 9/1942 | Tritt | 248/308 |
| 2,301,397 | 11/1942 | Hacker | 343/715 |
| 2,756,954 | 7/1956 | Whitlow | 248/538 |
| 2,899,155 | 8/1959 | Rogers | 248/514 |
| 3,450,378 | 6/1969 | Cucka | 248/514 |
| 3,555,551 | 1/1971 | Gronlund | 343/715 |

*Primary Examiner*—Eli Lieberman

*Attorney, Agent, or Firm*—Ned L. Conley; Murray Robinson; David Alan Rose

[57] ABSTRACT

An antenna-supporting arm is hingedly connected to a small semi-permanently attachable plate to be positioned in the usual rain channel underlying the margin of the hood of the engine compartment (or the lid of the trunk) of a motor vehicle. When the hood or lid is temporarily raised, the supporting arm and the antenna mounted thereon are swingable between an exposed normal use position, and a completely concealed undercover position for preventing theft or vandalism. A support-grounding pigtail lead bridges the hinge and is electrically connectable to the rain channel by one of the bolts fastening the small plate therein.

4 Claims, 6 Drawing Figures

SWINGABLE SUPPORT FOR CONCEALABLY MOUNTING ANTENNAS ON VEHICLES

BACKGROUND AND OBJECTS OF THE INVENTION

An exposed citizens'-band-type antenna proclaims the likely presence of a "CB" radio in the vehicle and thereby greatly increases the likelihood of actual or attempted theft thereof. Also an exposed antenna encourages vandalism. It is accordingly the principal object of this invention to provide a vehicle-antenna support which is quickly and easily swingable between an exposed normal use postion and a completely concealed position to discourage thieves and vandals. It is a further object to provide such a support which is quickly and easily installable, is durable, and is economical to manufacture. Other objects and advantages will become apparent as the following description proceeds.

BRIEF DESCRIPTION OF THE DRAWINGS

FIG. 5 is an enlarged fragmentary use-position elevational view in section on a plane perpendicular to the hinge axis.

Figure 1:
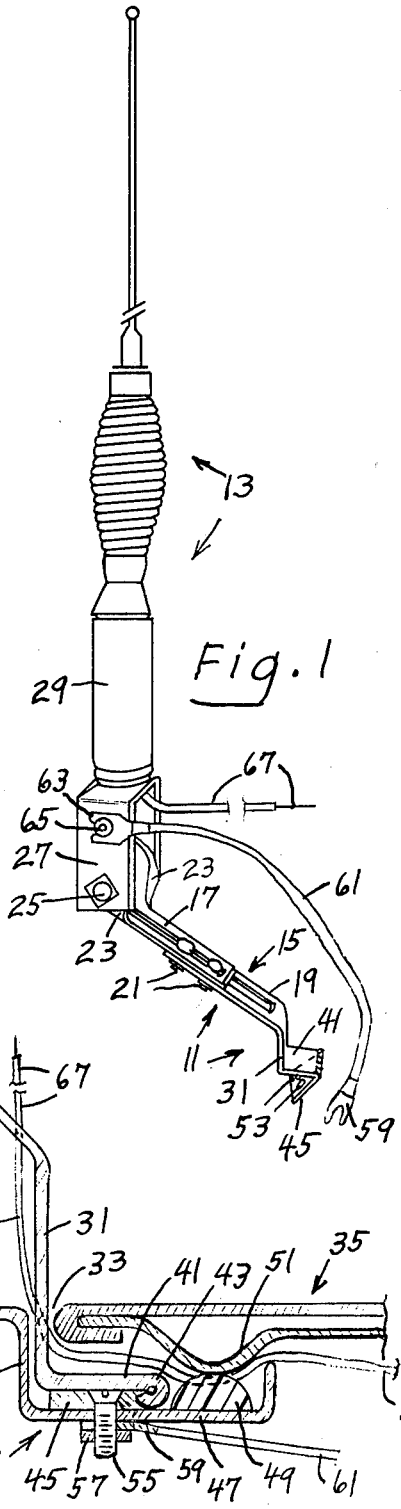
FIG. 1 is a perspective view of a preferred embodiment of the invention.
Figure 2:
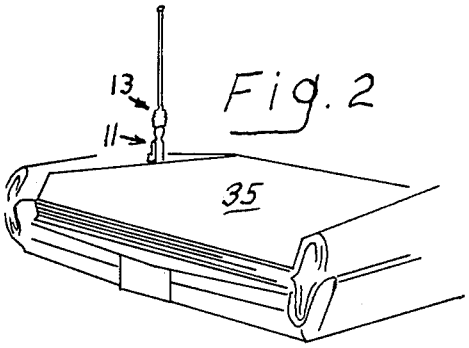
FIG. 2 is a perspective view of the support and antenna in their normal use position.
Figure 3:
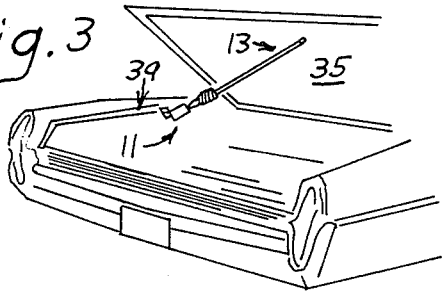
FIG. 3 is a perspective view showing the structure in a transitional position.
Figure 4:
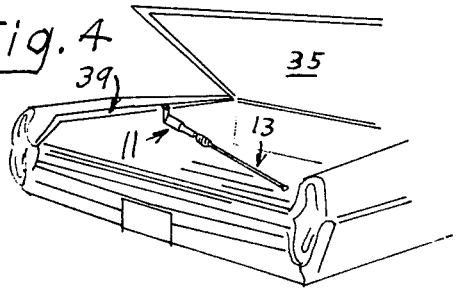
FIG. 4 shows the structure in its stored or non-use concealed position prior to trunk closing.
Figure 6:
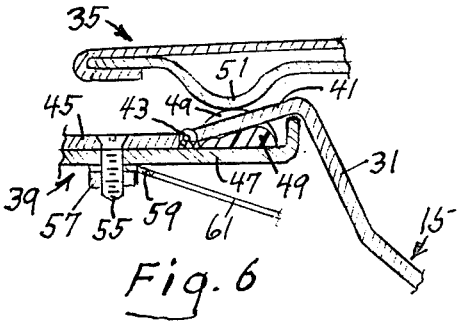
FIG. 6 is a view similar to FIG. 5 but showing the support in its concealed position.

With reference now to the drawings, the numeral 11 generally designates the concealable support for the CB antenna 13. The support 11 is disclosed as having an upwardly and laterally oriented (in use) arm 15 formed of two medially slotted metal straps 17 and 19, which are length-adjustably interconnected by nut-and-bolt pairs 21. However, the parts 17–21 could be a single non-adjustable strap designated 15. The upper end of the strap 15 has upwardly bent ears 23 apertured to receive a bolt 25 passing therethrough and through alined apertures in the arms of an inverted U-shaped strap 27 to fasten said parts together as shown. The bight portion of the U-shaped strap 27 has fixed thereto in known manner the base 29 of a known type of CB antenna 13.

The lower portion of the strap 15 has a vertical reach 31 that extends downwardly (FIG. 5) through the narrow gap 33 between the trunk lid 35 and the contiguous outer wall 37 of the conventional rain channel 39. In the rain channel 39, the strap 15 has a short horizontal reach 41 which terminates in spaced hinge-forming tabs bent around a hinge pin to form a hinge 43. A small metal plate 45 similarly forms the other half of the hinge 43, and it constitutes the stationary part of the antenna support.

The plate 45 lies on the top surface of the bottom 47 of the rain channel 39 between its outer wall 37 and a conventional compressible sponge-rubber water-excluding gasket 49 which is sealingly engaged by the bulge 51 of the trunk lid. The plate 45 has a pair of apertures 53 to receive bolts 55 which extend through installation-made holes in the bottom 47 of the rain channel 39. Bolts 55 and nuts 57 clamp together the plate 45, the bottom 47 of the rain channel, and the lower terminal 59 of a support-grounding pigtail lead 61. The upper terminal 63 of the pigtail lead 61 is connected to the U-shaped strap 27 by a rivet 65. The insulated antenna lead 67 enters the gap 33 (FIG. 5) preferably on the side of the support 11 opposite the pigtail lead 61.

While the drawings show the antenna support mounted for concealment in the trunk of a passenger automobile, it should be noted that it could equally well be mounted for swinging into any sufficiently large compartment having a movable cover (e.g. the hood-covered motor compartment of a car or truck).

Having thus described my invention, I claim:

1. A support for concealably mounting an antenna to an automotive vehicle having a relatively large compartment with a readily movable closure, said support comprising: a stationary member adapted for semi-permanent interior concealed attachment to vehicle structure defining the access opening of said compartment, and a movable antenna-supporting member swingably connected to said stationary member, whereby said movable member and its attached antenna can be readily swung between an exposed normal-use position and a completely concealed under-cover non-use position, said stationary member being a relatively small plate mountable flatly on the top side of the bottom of a conventional rain-channel, and said movable member being an L-shaped strap whose upright reach is adapted to extend upwardly through the usual narrow gap between a compartment closure member and adjacent vehicle structure, and whose horizontal reach is hinged at its end edge to said stationary small plate.

2. Structure according to claim 1, said small plate being semi-permanently attachable by at least one bolt-and-nut pair, said structure additionally including a support-grounding pigtail lead connected at its upper end to said movable member and to be clamped at its lower end between the under surface of said rain channel and a nut of said pair.

3. Structure according to claim 1 said movable member having an upwardly and laterally angled extension formed of two medially slotted straps interconnected by nut-and-bolt pairs for length adjustment of said member.

4. Structure according to claim 1, the upper end of said movable member being an inverted U-shaped strap, said antenna being supported on the upper surface of the bight portion of said U-shaped strap.

* * * * *